US005916466A

United States Patent [19]

Dixon

[11] Patent Number: 5,916,466

[45] Date of Patent: Jun. 29, 1999

[54] SPACE HEATER WITH ELEMENT SUPPORTS

[75] Inventor: Thomas Gildroy Shaw Dixon, Bromsgrove, United Kingdom

[73] Assignee: TFW Dixon & Son Limited, Worsc, United Kingdom

[21] Appl. No.: 09/045,739

[22] Filed: Mar. 19, 1998

[51] Int. Cl.[6] ..... H05B 3/06; H05B 3/60; H01C 3/10

[52] U.S. Cl. ..... 219/536; 99/325; 99/385; 373/120; 338/285; 338/290

[58] Field of Search ..... 219/536, 532, 219/542, 537; 99/325, 385; 373/119, 120; 338/285, 290, 315, 318, 319, 295

[56] References Cited

U.S. PATENT DOCUMENTS

| | | | |
|---|---|---|---|
| 1,147,916 | 7/1915 | Bailey | 219/536 |
| 1,439,997 | 12/1922 | Bird | 338/290 |
| 1,476,105 | 12/1923 | Pritzker | 338/321 |
| 2,271,978 | 2/1942 | Hjelmgren | 219/532 |
| 2,522,724 | 9/1950 | Scharf | 219/542 |
| 2,659,798 | 11/1953 | Olving | 338/287 |
| 2,834,867 | 5/1958 | White | 219/532 |
| 3,812,322 | 5/1974 | Osterkorn et al. | 219/532 |
| 3,860,789 | 1/1975 | Maake | 60/659 |
| 3,992,609 | 11/1976 | Alexander | 219/532 |
| 4,099,319 | 7/1978 | Vogel | 29/611 |
| 4,144,445 | 3/1979 | Thweatt | 219/532 |
| 4,243,872 | 1/1981 | Best | 219/532 |
| 4,289,955 | 9/1981 | Seeley | 219/532 |
| 4,392,052 | 7/1983 | Magnusson et al. | 219/532 |
| 4,418,679 | 12/1983 | Grayson | 126/201 |
| 4,445,024 | 4/1984 | Carden | 219/390 |
| 5,029,231 | 7/1991 | Carr et al. | 392/435 |
| 5,124,534 | 6/1992 | Williams et al. | 219/532 |
| 5,377,297 | 12/1994 | Nuutinen | 392/307 |

*Primary Examiner*—Teresa Walberg
*Assistant Examiner*—Daniel L. Robinson
*Attorney, Agent, or Firm*—Arthur L. Plevy

[57] ABSTRACT

A heating apparatus for an enclosure including at least a ceiling and a side wall, the apparatus includes a plurality of electrical resistance heating wires or sections of electrical resistance heating wire, and support means therefor. The support means include support members each having a first part adapted to be secured relative to the ceiling or side wall and a second part which projects inwardly of the enclosure, the second part including a plurality of spaced apart heating wire support formations. The support members and the heating wire support formations are arranged such that in use substantial portions of the length of each of the plurality of the heating wires or sections of heating wire, are supported side by side by the support members each parallel to or generally parallel to each other and to the ceiling or side wall of the enclosure.

17 Claims, 5 Drawing Sheets

SPACE HEATER WITH ELEMENT SUPPORTS

BACKGROUND TO THE INVENTION

The invention relates to a heating apparatus for an enclosure having at least a ceiling and a side wall, apparatus comprising an electric heating element and support means therefor, and in particular although not exclusively, such a heating apparatus for a kiln for firing ceramics.

Many forms of heating apparatus for use in enclosures such as kilns and furnaces are known. All of these prior all forms of heating apparatus suffer from disadvantages of one kind or other.

In general heating enclosures such as kilns are provided with a plurality of heating apparatus. Each heating apparatus preferably forms a separate electrical circuit, such that if one fails the effect on the firing of the kiln is not too great, but several may be incorporated in one electric circuit. Hence, it is not desirable for the electrical elements used to have too large a cross sectional area as that limits the number which can be used.

One form of prior art heating apparatus comprises strip or ribbon heating elements. On the walls of enclosures these may simply be hung over support means of various kinds protruding from the ceiling and/or wall, and in general hang down between successive support means. On the ceiling of the enclosure they may be wound around two spaced apart lines of support means, protruding from the ceiling, in a zig-zag formation parallel to the ceiling, or draped over support means suspended from the ceiling, and in general hang down between successive support means in a similar fashion to the walls. On the floor of an enclosure they may simply be laid in a zig zag fashion in troughs provided in the floor. However, strip or ribbon heating elements have a relatively large cross sectional area and therefore only a relatively small number of circuits can be provided.

An alternative form of prior all heating apparatus provides rod elements, which may be supported in the same ways as the strip or ribbon elements previously described. These suffer from the same disadvantages as the strip or ribbon elements.

Many prior art heating apparatus comprise heating elements in the form of wire spirals or coils. These may be supported in channels provided in the walls, ceiling or floor of the enclosure, or on trays supported from the appropriate surface of the enclosure. Such heating elements suffer from the disadvantage that as they under go heating and cooling cycles they migrate towards cold areas of the enclosure, for example towards the enclosure door. This results in an uneven distribution of the coil loops along the length of the coils. This in turn produces a number of deleterious effects. First, some parts of the enclosure are heated to a higher temperature than others resulting in uneven firing. Second, where the loops of the coil are so tightly bunched as to approximate to a tube the heat transfer is poor, which produces generally inefficient heating thus requiring greater power input, and shortening heating element life as they may reach higher temperatures than they are designed to withstand. Third, where such elements are supported on trays these often suffer from an excess of heat and start to warp thus requiring replacement.

Wire spirals or coils may also be provided in free radiating form, that is, wound around supporting rods which are themselves supported from the appropriate surface of the enclosure. These elements suffer from the same kinds of disadvantages.

SUMMARY OF THE INVENTION

It is an object of the invention to provide an improved form of heating apparatus for an enclosure.

According to a first aspect of the invention there is provided a heating apparatus for an enclosure comprising at least a ceiling and a side wall, the apparatus comprising a plurality of electrical resistance heating wires or sections of electrical resistance heating wire, and support means therefor, the support means comprising support members each having a first part adapted to be secured relative to the ceiling or side wall and a second part which projects inwardly of the enclosure, the second part comprising a plurality of spaced apart heating wire support formations, the support members and the heating wire support formations being arranged such that in use substantial portions of the length of each of the plurality of the heating wires or sections of heating wire, are supported side by side by the support members each parallel to or generally parallel to each other and to the ceiling or side wall of the enclosure.

The invention provides the advantage that the problem of migration towards cool areas of the enclosure is greatly reduced.

The lengths of each of the plurality of heating wires or sections of heating wire may preferably hang down between successive support members, and the support means further comprises spacer members each comprising a plurality of spaced apart heating wire separation formations, the spacer members and the heating wire separation formations being arranged such that in use each spacer member is located on the plurality of heating wires or sections of heating wire between successive support members to maintain the heating wires or sections of heating wire parallel to or generally parallel to each other.

The spaced apart heating wire support formations may comprise spaced apart substantially parallel indentations in an upper surface of the second part of each support member.

The heating wire separation formations may comprise spaced apart substantially parallel indentations in a lower surface of each spacer member.

Preferably the spacer members are not secured relative to the ceiling or side wall of the enclosure.

The plurality of electrical resistance heating wires or sections of electrical resistance heating wire preferably comprises a single wire arranged to provide a plurality of sections.

The ceiling and at least one side wall may be lined with ceramic fibre with engagement means provided within the fibre, and the first parts of the support members may comprise one or more hook formations adapted to engage with the engagement means. The engagement means may comprise elongate members lying parallel or generally parallel to the ceiling or side wall.

In an alternative where the ceiling and at least one side wall are lined with ceramic fibre and clad with metal sheet, and engagement means may be provided on the inner face of the metal sheet adapted to engage with the first parts of the support members. The engagement means may comprise sockets and the first parts of the support members may comprise elongate elements which are adapted to be received in the sockets. Alternatively, the engagement means may comprise protruding elements and the first parts of the support members may comprise bores adapted to locate on the protruding elements. The protruding elements may extend through the wall and into the enclosure.

The ceiling and at least one side wall may be lined with brick, and bores may be provided in the brick for receipt of the first pails of the support members.

According to a second aspect of the invention, there is provided an enclosure comprising at least a ceiling and a side wall, and at least one heating apparatus according to the first aspect of the invention.

BRIEF DESCRIPTION OF THE DRAWINGS

Embodiments of the invention will now be described, by way of example only, with reference to the accompanying drawings.

DESCRIPTION OF THE PREFERRED EMBODIMENT

Figure 1:
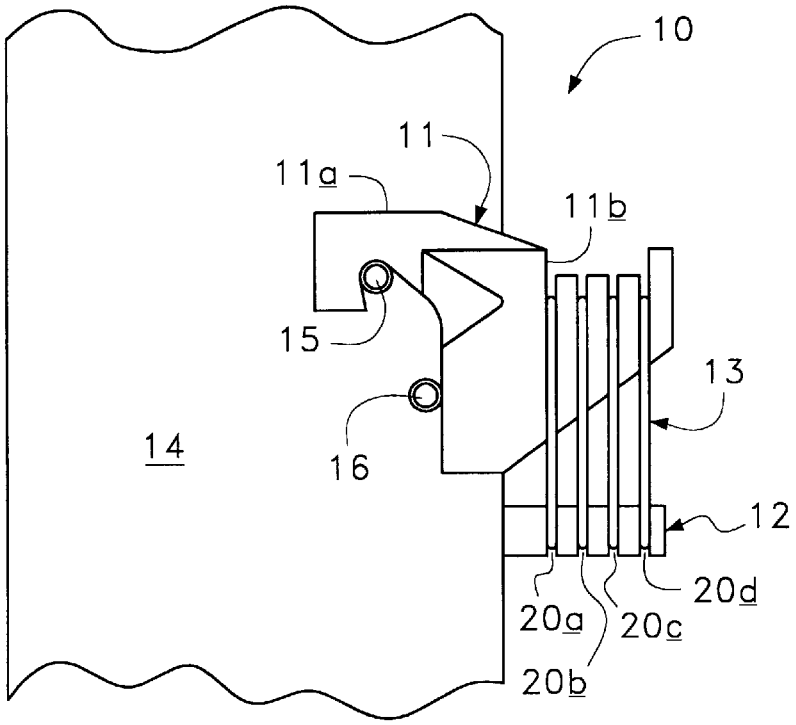
FIG. 1 is a side view in partial cross section of a preferred embodiment of the invention for use in a ceramic fibre lined enclosure.
Figure 2:
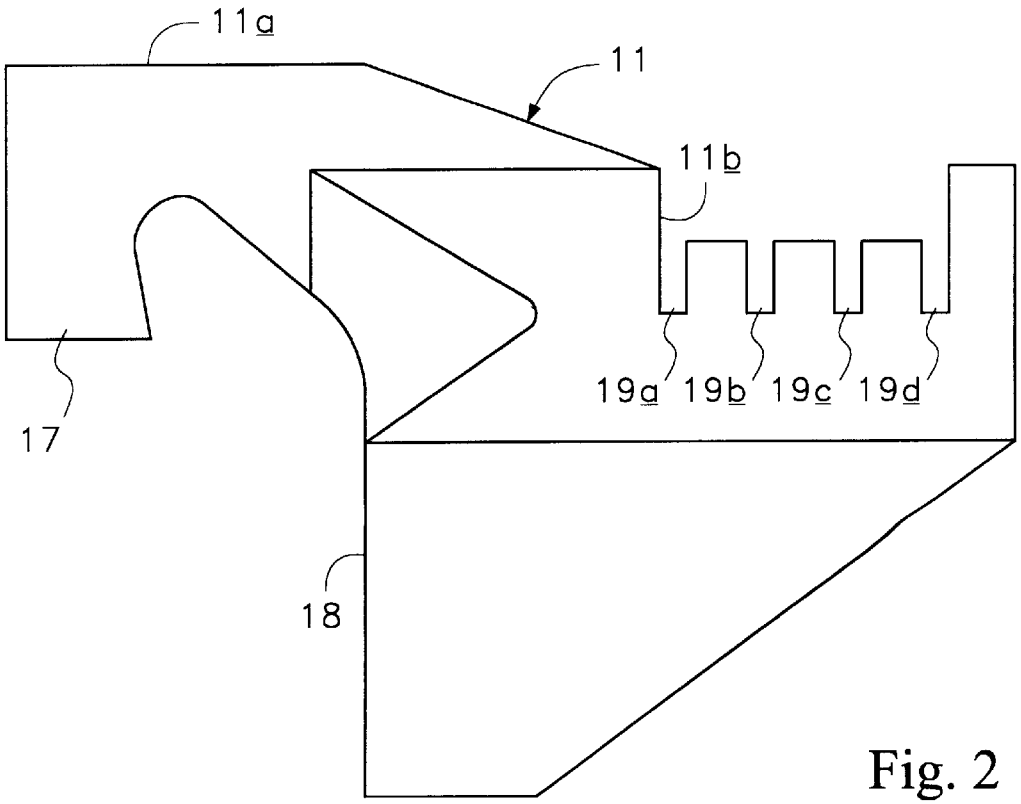
FIG. 2 shows a support member of the FIG. 1 embodiment in greater detail.
Figure 3:
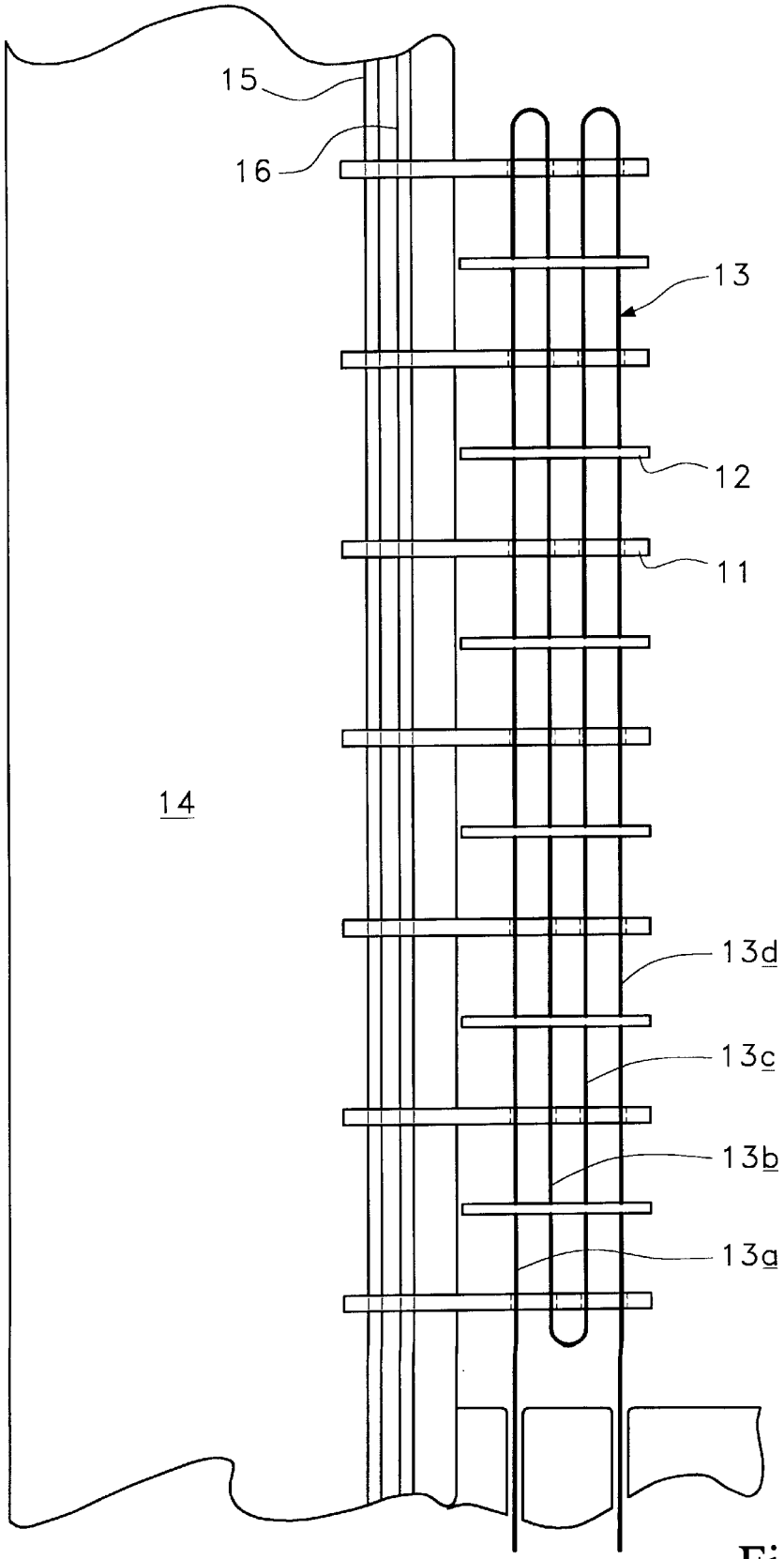
FIG. 3 illustrates in partial cross section a plan view of the FIG. 1 embodiment.

Referring to FIGS. 1 to 3, a heating apparatus 10 comprises support means in the form of a support member 11 and a spacer member 12, and a heating element 13 in the form of a wire. The heating apparatus 10 is provided for an enclosure having at least a wall and a ceiling, a part of the at least one wall 14 being shown in section in FIGS. 1 and 3. In this embodiment the wall is constructed from ceramic fibre. The support member 11 comprises a first part 11*a* adapted to be secured to the wall 14, and is secured thereto as described below, and a second part 11*b* which projects inwardly of the enclosure.

Engagement means in the form of upper and lower ceramic tubes 15, 16 are provided within the wall 14. The first part 11*a* of the support member 11 comprises a book portion 17 which engages around the upper tube 15, and a bearing portion 18 which rests against or bears on the lower tube 16.

The second part 11*b* of the support member 11 comprises a plurality of spaced apart heating wire support formations, in this case four indentations 19*a* to 19*d*, in its upper surface for receipt of the heating element 13. The spacer member 12 comprises a plurality of heating wire spacer formations, in this case four indentations 20*a* to 20*d* for receipt of the heating element 13. Both the support member 11 and spacer member 12 are formed from electrically insulating material, typically cordierite which is a ceramic material with low iron content and low thermal expansion.

The heating element 13 is formed of a single piece of electrical resistance heating wire of known kind, for example, nickel chromium alloy or ferrous chromium aluminium alloy. The heating element 13 is arranged to have a plurality of sections, in this embodiment four sections 13*a* to 13*d* which extend along substantially parallel paths, as shown in FIG. 3. In general there will be an even number of sections for ease of electrical connection.

The heating element 13 is supported by a number, in this case seven, of support members 11 with the respective sections 13*a* to 13*d* of the heating element 13 received within respective indentations 19*a* to 19*d* in each support member 11. Between successive support members 11, the heating element 13 hangs downwards forming loops as shown in FIG. 1. A spacer member 12 is located on the heating element 13 between each pair of support members 12, with the respective sections 13*a* to 13*b* of the heating element 13 received within respective indentations 20*a* to 20*d* of the spacer member 12. The spacer member 12 simply selves to maintain the separation between the different sections 13*a* to 13*b* of the heating element 13.

The heating apparatus 10 thus described provides the advantage that the electrical element 13 cannot migrate towards the cooler areas of the enclosure to the same extent. The heating element 13 will contract when it cools, but this will result principally in a change in shape of the loops of the element 13 between successive support members 11, which has little effect on their performance. Hence, heating apparatus 10 according to the invention do not suffer from the same problems of uneven heat distribution and thus inefficient heating of the enclosure, nor do they suffer from the disadvantage of shortened element life, to the same extent.

Figure 4:
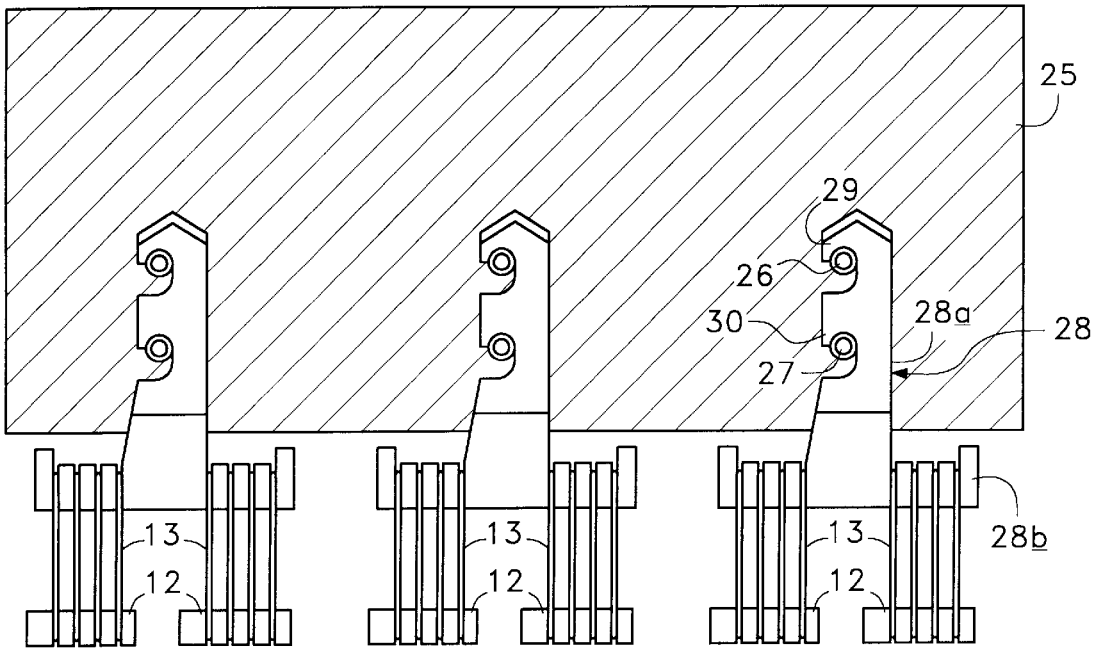
FIG. 4 illustrates in partial cross section an embodiment of the invention suitable for use on the ceiling of a ceramic fibre lined enclosure.

Referring now to FIG. 4, an embodiment of a heating apparatus 24 according to the invention suitable for use on the ceiling of a ceramic fibre lined enclosure is illustrated, with like parts being like referenced. An enclosure ceiling 25 has engagement means in the form of pairs of ceramic tubes 26, 27 driven through it, and a first part 28*a* of a support member 28 comprises pairs of hook portions 29, 30, which engage with the tubes 26,27 to secure the support member 28 in place. A second part 28*b* of the support member 28 provides formations 19 as previously described, in this case two sets, for the receipt of two heating elements 13.

Figure 5:
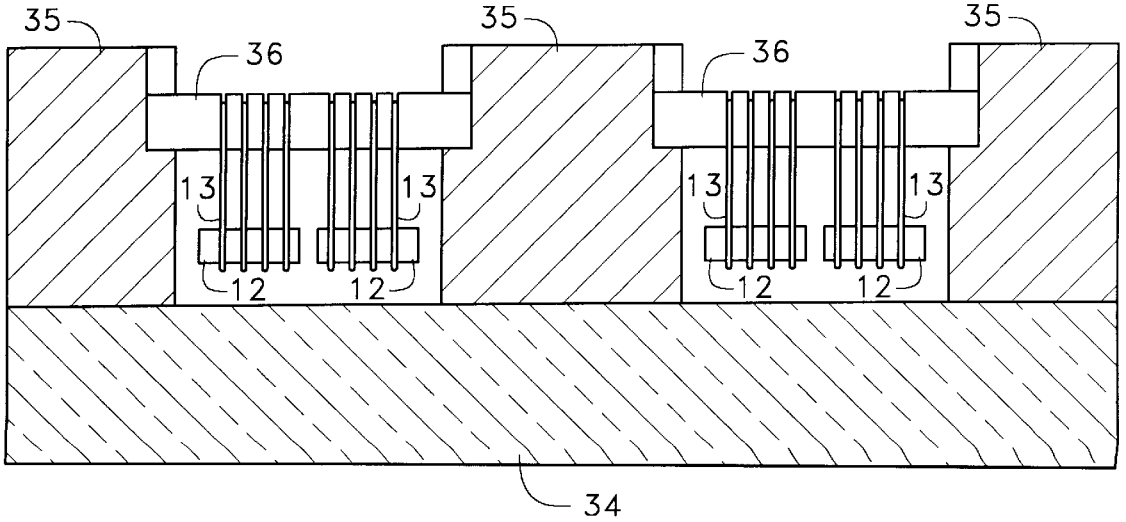
FIG. 5 shows an embodiment in partial plan view suitable for use on the floor of a enclosure or a kiln car.

Referring now to FIG. 5, a further adaptation of the invention for the provision of heating elements 13 to the floor of an enclosure, or to a kiln car is illustrated, with like parts being like referenced. An enclosure 34, comprises upstanding portions 35 which provide shoulders on which support members 36 rest. The upstanding portions also support the load within the enclosure for firing. The support members 36 provide sets of formations 19 as previously described, each set of formations for receipt of a respective heating element 13.

Figure 6:
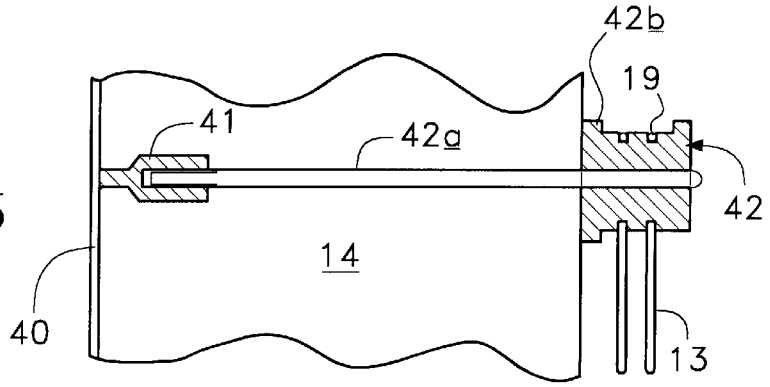
FIGS. 6 to 9 illustrate alternative embodiments of support members according to the invention and their attachment to the wall of an enclosure.
Figure 7:
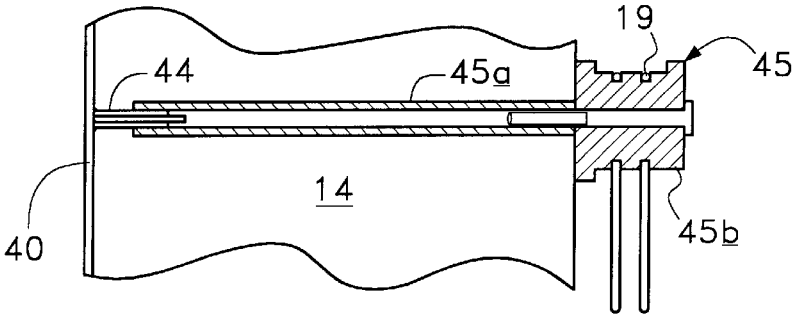
Figure 8:
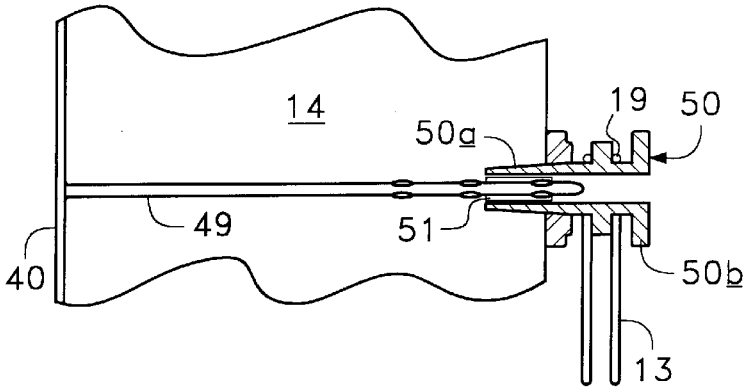
Figure 9:
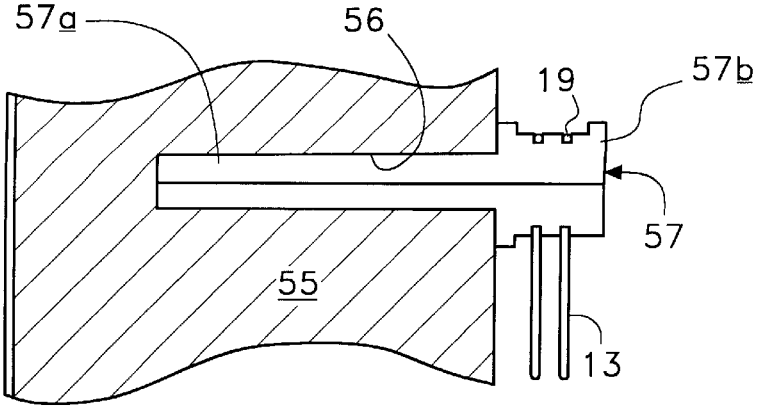

Referring now to FIGS. 6 to 9, further embodiments of support members according to the invention are illustrated. The support members of FIGS. 6 to 8 are appropriate for use in ceramic fibre lined enclosures whilst the embodiment of FIG. 9 is appropriate for use in a brick lined enclosure.

Referring in particular to FIG. 6, a ceramic fibre wall 14 is supported from a metal case 40, to the inner face of which an engagement means in the form of a socket 41 is fixed by welding. A support member 42 comprises a first part 42*a*, in the form of a heat resistant rod, which passes through the ceramic fibre wall 14 and locates in the socket 41, and a second part 42*b* in the form of a ceramic bobbin, mounted on the rod and providing the appropriate formations 19.

Referring in particular to FIG. 7, the ceramic fibre wall 14 is again supported from a metal case 40 and an engagement means in the form of a threaded stud 44 is attached to the inner face by welding. A support member 45 comprises a first part 45*a*, in the form of a ceramic tube which penetrates through the ceramic fibre wall 14 and locates on the threaded stud 44 and a second part 45*b*, in the form of a ceramic bobbin mounted on the tube, which provides the required formations 19 for receipt of the heating element 13.

Referring now in particular to FIG. 8, the ceramic fibre wall 14 is again supported from a metal case 40 to the inner face of which an engagement means in the form of a locating rod 49 is attached by welding. The locating rod 49 is of sufficient length that it penetrates completely through the ceramic fibre wall 14 into the enclosure . A ceramic support member 50 comprises a first part 50*a* which penetrates into the wall 14 and locates on the rod 49, by means of a bore 51. A second part 50*b* of support member 50 provides the required formations 19 for receipt of the heating element 13, and comprises a washer portion which ensures the formations 19 are spaced appropriately from the wall 14.

Referring now to FIG. 9 in particular, a wall 55 of brick comprises an engagement means in the form of a bore 56. Support member 57 comprises a first part 57*a* in the form of an elongate portion which locates in the bore 56, and a second part 57*b* which extends into the enclosure and provides the required formations 19 for receipt of the heating element 13.

Many other forms of support members may be provided within the scope of the invention.

Figure 11:
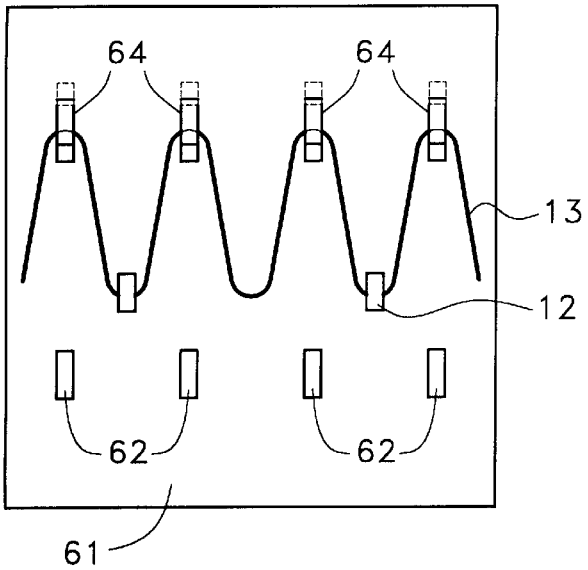
FIG. 11 illustrates a front view of the FIG. 10 embodiment.
Figure 12:
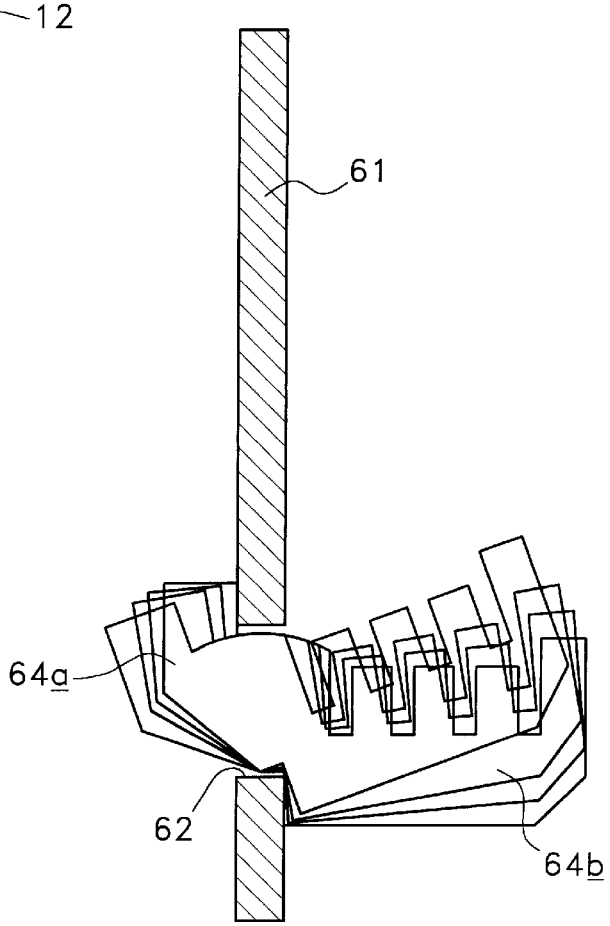
FIG. 12 illustrates a support member of the FIG. 10 embodiment being inserted.
Figure 10:
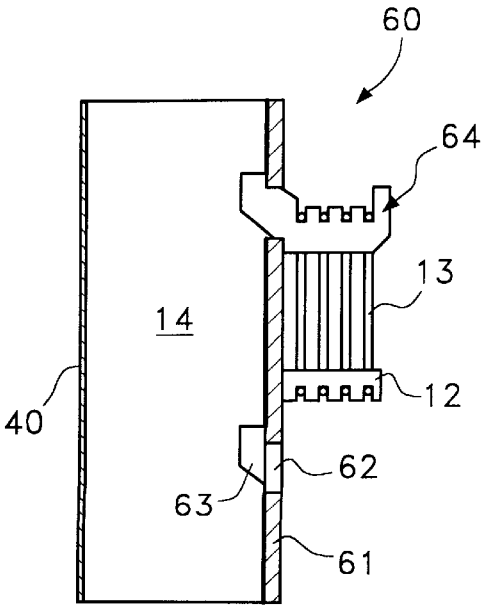
FIG. 10 illustrates a side view in partial cross-section of an alternative embodiment of a heating apparatus according to the invention.

Referring now to FIGS. 10 to 12 a further embodiment of a heating apparatus 60 according to the invention is illustrated, with like parts being like referenced. A fibre lined wall 14 is supported from a metal case 40. To the inner surface of the fibre wall 14 a sheet of cordierite 61 is adhered, the sheet 61 provides engagement means in the form of holes 62 adjacent voids 63 in the fibre wall 14. Each support member 64, comprises a first part 64*a* shaped and adapted for engagement in hole 62 and void 63, and a second pail 64*b* which provides the formations 19. The support members 64 are engaged in the holes 62, as shown in FIG. 12, by rotation during insertion.

For most heating enclosures, a plurality of such heating apparatus 10 are provided. In particular, it is beneficial to provide a plurality of separate heating elements each forming a separate electric circuit such that if one heating element fails the effect on the heating of the kiln as a whole is not so significant as to cause failure of the whole filing process. For example, if the heating enclosure uses a three phase electrical supply, it may be provided with a total of 18 circuits, six on each phase.

The plurality of heating apparatus according to the invention are distributed appropriately around the enclosure to provide heating that is as even as possible. Thus, they may be separated by greater distances towards the top of the enclosure to aid temperature uniformity within the enclosure.

The electrical elements described above comprise four sections running substantially parallel to each other and to the wall and/or the ceiling of the enclosure. Clearly, electrical elements with fewer or more sections may be used in embodiments of heating apparatus according to the invention, according to the particular circumstances. Indeed, the heating apparatus within a single enclosure may comprises elements with differing numbers of sections. In particular to aid temperature uniformity elements towards the top of the enclosure may comprise fewer sections than those towards the bottom of the enclosure.

The features disclosed in the foregoing description the following claims or the accompanying drawings, expressed in their specific forms or in terms of a means for performing the disclosed function, or a method or process for attaining the disclosed result, or a class or group of substances or compositions, as appropriate, may, separately, or in any combination of such features, be utilised for realising the invention in diverse forms thereof.

I claim:

1. A heating apparatus for an enclosure comprising at least a ceiling and a side wall, the apparatus comprising a plurality of electrical resistance heating wires or sections of electrical resistance heating wire, and support means therefor, the support means comprising:

a plurality of support members each comprising:

a first part adapted to be secured relative to the ceiling or side wall; and, a second part which projects inwardly of the enclosure, each second part comprising a plurality of spaced apart heating wire support formations, the support members and the heating wire support formations being arranged such that in use substantial portions of the length of each of the plurality of the heating wires or sections of heating wire, are supported side by side by the support members each parallel to or generally parallel to each other and to the ceiling or side wall of the enclosure and hang down between successive support members; and, a plurality of heating wire spacer members each comprising a plurality of spaced apart heating wire separation formations, the spacer members and the heating wire separation formations being arranged such that in use each spacer member is located on the plurality of heating wires or sections of heating wire and between successive support members to maintain the heating wires or sections of heating wire parallel to or generally parallel to each other.

2. A heating apparatus according to claim 1 wherein the spaced apart heating wire support formations comprise spaced apart substantially parallel indentations in an upper surface of the second part of each support member.

3. A heating apparatus according to claim 1 wherein the heating wire separation formations comprise spaced apart substantially parallel indentations in a lower surface of each spacer member.

4. A heating apparatus according to claim 2 wherein the spacer members are not secured relative to the ceiling or side wall of the enclosure.

5. A heating apparatus according to claim 1 wherein the plurality of electrical resistance heating wires or sections of electrical resistance heating wire comprise a single wire arranged to provide a plurality of sections.

6. A heating apparatus according to claim 1 wherein the ceiling and the side wall are lined with ceramic fibre and engagement means are provided within the fibre, and wherein the first pails of the support members comprise one or more hook formations adapted to engage with the engagement means.

7. A heating assembly according to claim 6 wherein the engagement means comprises elongate elements lying parallel or generally parallel to the ceiling or side wall.

8. A heating assembly according to claim 1 wherein the ceiling and the side wall are lined with ceramic fibre supported from a metal case, and engagement means are provided on the inner face of the metal case adapted to engage with the first parts of the support members.

9. A heating assembly according to claim 8 wherein the engagement means comprise sockets and the first parts of the support members comprise elongate elements which are adapted to be received in the sockets.

10. A heating assembly according to claim 8 wherein the engagement means comprise protruding elements and the first parts of the support members comprise bores adapted to locate on the protruding elements.

11. A heating assembly according to claim 10 wherein the protruding elements extend through the wall and into the enclosure.

12. A heating assembly according to claim 1 wherein the ceiling and the side wall are lined with ceramic fibre to the inner face of which a sheet of solid material is affixed which provides engagement means in the form of holes therethrough, and the first parts of the support members comprise portions adapted to engage the holes.

13. A heating assembly according to claim 1 wherein the ceiling and the side wall are lined with brick, and bores are provided in the brick for receipt of the first parts of the support members.

14. A heating apparatus comprising:

an enclosure including at least a ceiling and a side wall;

a plurality of electrical resistance heating wires or sections of electrical resistance heating wire;

at least one support member for supporting said plurality of electrical resistance heating wires or sections of electrical resistance heating wire within said enclosure, and comprising a first part adapted to be secured to said ceiling or side wall, and a second part which projects into said enclosure;

a plurality of spaced apart heating wire support formations positioned on said second part of said at least one support member;

at least one heating wire spacer member arranged adjacent to said plurality of electrical resistance heating wires or sections of electrical resistance heating wire within said enclosure; and, a plurality of spaced apart heating wire separation formations positioned on said at least one heater wire spacer;

wherein said at least one support member and said plurality of heating wire support formations are arranged such that in use said plurality of heating wires or sections of heating wire remain generally parallel to each other and to said ceiling or sidewall; and, wherein said at least one spacer member and said plurality of heating wire separation formations are arranged such that in use said plurality of heating wires or sections of heating wire remain generally parallel to each other.

15. The apparatus of claim 14, wherein said at least one spacer member is not secured to the ceiling or side wall of the enclosure.

16. The apparatus of claim 15, wherein said at least one spacer member is supported by said plurality of heating wires or sections of heating wire.

17. The apparatus of claim 16, further comprising a plurality of support members and a plurality of wire spacer members arranged alternately in sequence along said ceiling or side wall, wherein said plurality of heating wires or sections of heating wire hang down between successive support members.

* * * * *

UNITED STATES PATENT AND TRADEMARK OFFICE

CERTIFICATE OF CORRECTION

PATENT NO. : 5,916,466
DATED : June 29, 1999
INVENTOR(S) : Dixon

It is certified that error appears in the above-identified patent and that said Letters Patent is hereby corrected as shown below:

The Foreign Application Priority Data was omitted.

Please insert -- Foreign Application Priority Data
Mar. 21, 1997 [UK] United Kingdom.....GB9705895.2 --

Please note that the Priority Document was originally submitted on May 18, 1998. A copy of the Priority Document and the marked acknowledgment postcard is submitted herewith. Paper No. 2 indicated that none of the Priority Documents were received. A copy of the Priority Document was resubmitted on February 19, 1999, a copy of the marked acknowledgment postcard is submitted herewith.

Signed and Sealed this

Eighteenth Day of September, 2001

*Attest:*

Nicholas P. Godici

NICHOLAS P. GODICI

*Attesting Officer* *Acting Director of the United States Patent and Trademark Office*